US008272914B2

(12) United States Patent
Min et al.

(10) Patent No.: US 8,272,914 B2
(45) Date of Patent: Sep. 25, 2012

(54) METHOD OF MANUFACTURING FIELD EMISSION ELECTRODE HAVING CARBON NANOTUBES WITH CONDUCTIVE PARTICLES ATTACHED TO EXTERNAL WALLS

(75) Inventors: Yo-sep Min, Yongin-si (KR); Eun-ju Bae, Seoul (KR); Wan-jun Park, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 13/137,743

(22) Filed: Sep. 9, 2011

(65) Prior Publication Data

US 2012/0003895 A1 Jan. 5, 2012

Related U.S. Application Data

(62) Division of application No. 12/003,134, filed on Dec. 20, 2007.

(30) Foreign Application Priority Data

Jan. 5, 2007 (KR) ..... 10-2007-0001703

(51) Int. Cl.
*H01J 1/62* (2006.01)
*H01J 63/02* (2006.01)

(52) U.S. Cl. ..... 445/51; 313/309; 313/310; 313/496

(58) Field of Classification Search ..... 445/23, 445/51; 313/495–498, 309–310
See application file for complete search history.

(56) References Cited

U.S. PATENT DOCUMENTS

| | | | | |
|---|---|---|---|---|
| 6,057,637 | A | 5/2000 | Zettl et al. | |
| 7,040,948 | B2 | 5/2006 | Mao et al. | |
| 7,057,203 | B2 | 6/2006 | Mao et al. | |
| 7,799,307 | B2 * | 9/2010 | Bae et al. | 423/447.1 |
| 2004/0121073 | A1 * | 6/2004 | George et al. | 427/215 |
| 2004/0195950 | A1 | 10/2004 | Ryu et al. | |
| 2005/0212394 | A1 | 9/2005 | Lin et al. | |

(Continued)

FOREIGN PATENT DOCUMENTS

JP 2005-222847 8/2005

(Continued)

OTHER PUBLICATIONS

Hata et al. Water-Assisted Highly Efficient Synthesis of Impurity-Free Single-Walled Carbon Nanotubes, Nov. 2004, Science Magazine, vol. 306, pp. 1362-1364.*

(Continued)

*Primary Examiner* — Tracie Y Green
(74) *Attorney, Agent, or Firm* — Harness, Dickey & Pierce, P.L.C.

(57) ABSTRACT

Provided are a field emission electrode, a method of manufacturing the field emission electrode, and a field emission device including the field emission electrode. The field emission electrode may include a substrate, carbon nanotubes formed on the substrate, and a conductive layer formed on at least a portion of the surface of the substrate. Conductive nanoparticles may be attached to the external walls of the carbon nanotubes.

8 Claims, 8 Drawing Sheets

U.S. PATENT DOCUMENTS

| | | | | |
|---|---|---|---|---|
| 2006/0017368 | A1 | 1/2006 | Bae et al. | |
| 2006/0226763 | A1 | 10/2006 | Moon et al. | |
| 2006/0231381 | A1 | 10/2006 | Jensen et al. | |
| 2007/0020167 | A1 | 1/2007 | Han et al. | |
| 2007/0114905 | A1 | 5/2007 | Kurachi et al. | |
| 2007/0154623 | A1 * | 7/2007 | Min et al. | 427/64 |
| 2007/0222356 | A1 | 9/2007 | Qian et al. | |
| 2007/0236133 | A1 * | 10/2007 | Bae et al. | 313/496 |

FOREIGN PATENT DOCUMENTS

| | | |
|---|---|---|
| KR | 10-2003-0097125 | 12/2003 |
| KR | 10-2004-0101280 | 12/2004 |
| KR | 10-2006-0092438 | 8/2006 |
| KR | 10-2006-0108165 | 10/2006 |

OTHER PUBLICATIONS

Li et al., Preferential Growth of Semiconducting Single-Walled Carbon Nanotubes by a Plasma Enhanced CVD Method Jan. 2004,Nano Letters, vol. 4. No. 2, pp. 317-321.*

Damon B. Farmer et al., "ALD of High-k Dielectrics on Suspended Functionalized SWNTs," Electrochemical and Solid-State Letters, 8 (4) G89-G91 (2005); Division of Engineering and Applied Sciences, Department of Chemistry and Chemical Biology, Harvard University, Cambridge, MA, USA.

Office Action mailed Nov. 1, 2011, in co-pending U.S. Appl. No. 12/003,134.

* cited by examiner

METHOD OF MANUFACTURING FIELD EMISSION ELECTRODE HAVING CARBON NANOTUBES WITH CONDUCTIVE PARTICLES ATTACHED TO EXTERNAL WALLS

PRIORITY STATEMENT

This application is a divisional under 35 U.S.C. §121 of U.S. application Ser. No. 12/003,134, filed on Dec. 20, 2007, which claims priority under 35 U.S.C. §119 to Korean Patent Application No. 2007-0001703, filed on Jan. 5, 2007, in the Korean Intellectual Property Office (KIPO), the entire contents of each of which are hereby incorporated by reference.

BACKGROUND

1. Field

Example embodiments relate to a field emission electrode using carbon nanotubes as emitters, a method of manufacturing the field emission electrode, and a field emission device comprising the field emission electrode.

2. Description of Related Art

Due to the recent development of display techniques, flat panel displays have become more common place than traditional cathode ray tubes (CRTs). Representative flat panel displays being developed include liquid crystal displays (LCDs), plasma display panels (PDPs), and field emission displays (FEDs) using carbon nanotubes. FEDs may have the same advantages as CRTs (e.g., higher brightness and a wider viewing angle), and the advantages of LCDs may include a smaller thickness and a lighter weight. Thus, FEDs are expected to be the next generation display devices.

In FEDs, when electrons are emitted from a cathode and collide with a fluorescent layer on an anode, the fluorescent material is excited, thereby emitting light of a specific color. FEDs are different from CRTs in that electron emitters are formed of a cold cathode material.

Carbon nanotubes are primarily used as electron emitters of FEDs. In particular, single-wall carbon nanotubes (SWNTs) have smaller diameters and may emit electrons at lower voltages than multi-wall carbon nanotubes. As such, SWNTs are considered to be emitters of field emission electrodes.

In the field emission electrode (using carbon nanotubes), electron emitters are formed by coating a paste containing carbon nanotubes on a substrate and treating the substrate with heat. However, various organic materials (e.g., solvents, binders, and/or etc.) contained in the paste remain as residuals after the heat treatment, thereby reducing the life of the device.

Carbon nanotubes may have defects caused by the damage to the $sp^2$ bonds between the carbons comprising the carbon nanotubes. The defects may reduce the life of the carbon nanotubes and thus, there is a need to reduce or prevent formation of defects.

SUMMARY

Example embodiments provide a field emission electrode comprising carbon nanotubes having a longer life. Example embodiments also provide a method of manufacturing the field emission electrode and a field emission device comprising the field emission electrode.

According to example embodiments, a field emission electrode may comprise a substrate, carbon nanotubes formed on the substrate, and a conductive layer on at least a portion of the surface of the substrate. Conductive nanoparticles may be attached to the external walls of the carbon nanotubes.

The carbon nanotubes may be grown on the substrate or may be formed using a chemical vapor deposition method using $H_2O$ plasma. A catalyst to accelerate growth of the carbon nanotubes may be further present on the substrate.

Attachment of the conductive nanoparticles and formation of the conductive layer may be performed using an atomic layer deposition method.

According to example embodiments, a method of manufacturing a field emission electrode may comprise forming carbon nanotubes on a substrate and forming a conductive layer on at least a portion of the surface of the substrate simultaneously with attaching conductive nanoparticles to external walls of the carbon nanotubes.

According to example embodiments, a field emission device may comprise the field emission electrode.

Because the field emission electrode may comprise the carbon nanotubes having a longer life, a field emission device using the field emission electrode may be of a higher quality.

BRIEF DESCRIPTION OF THE DRAWINGS

Example embodiments will be more clearly understood from the following detailed description taken in conjunction with the accompanying drawings. FIGS. 1-10 represent non-limiting, example embodiments as described herein.

FIG. 1 is a schematic cross-sectional view illustrating a field emission electrode according to an example embodiment;

FIG. 2 is a schematic cross-sectional view illustrating a field emission electrode according to an example embodiment;

FIG. 3 is a schematic cross-sectional view illustrating a field emission electrode according to an example embodiment;

FIG. 4 is a schematic cross-sectional view illustrating a field emission electrode according to an example embodiment;

FIG. 6 is a schematic cross-sectional view illustrating a field emission device comprising a field emission electrode according to an example embodiment;

FIG. 10 is a graph illustrating the life of the carbon nanotubes obtained in an example and a comparative example, respectively.

DETAILED DESCRIPTION OF EXAMPLE EMBODIMENTS

Figure 1:
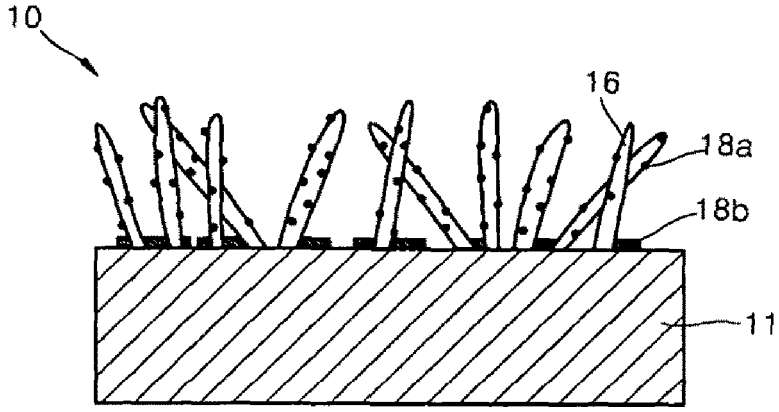

Reference will now be made in detail to example embodiments, examples of which are illustrated in the accompanying drawings. However, example embodiments are not limited to the embodiments illustrated hereinafter, and the embodiments herein are rather introduced to provide easy and complete understanding of the scope and spirit of example embodiments. In the drawings, the thicknesses of layers and regions are exaggerated for clarity.

It will be understood that when an element or layer is referred to as being "on," "connected to" or "coupled to" another element or layer, it may be directly on, connected or coupled to the other element or layer or intervening elements or layers may be present. In contrast, when an element is referred to as being "directly on," "directly connected to" or "directly coupled to" another element or layer, there are no intervening elements or layers present. Like reference numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" may encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle may, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a schematic cross-sectional view illustrating a field emission electrode according to an example embodiment.

Referring to FIG. 1, a field emission electrode 10 may comprise a substrate 11, carbon nanotubes 16 formed on the substrate 11, and a conductive layer 18*b* formed on at least a portion of the surface of the substrate 11. Conductive nanoparticles 18*a* may be attached to the external walls of the carbon nanotubes 16.

The substrate 11 may be any conventional substrate used in field emission electrodes, for example, a glass or a semiconductor substrate, but is not limited thereto.

The carbon nanotubes 16 may be formed on the substrate 11. The carbon nanotubes 16 may also be grown on the substrate 11 using any one of the various methods known in the art. The carbon nanotubes 16 may be formed on the substrate 11 using a chemical vapor deposition (CVD) method using $H_2O$ plasma. The CVD method will now be described in detail below.

The carbon nanotubes 16 may be multi-wall carbon nanotubes or single-wall carbon nanotubes (SWNTs). The carbon nanotubes 16 may have a diameter of about 5 nm or less (e.g., 0.001-5 nm, and more particularly 0.001-3 nm) and a length of several hundreds of nanometers, and therefore, they may have a higher aspect ratio. For example, the carbon nanotubes 16 may be SWNTs, which may have a smaller diameter than the multi-wall carbon nanotubes.

The conductive nanoparticles 18*a* may be attached to the external walls of the carbon nanotubes 16 and may be attached to defects on the external walls of the carbon nanotubes 16. Thus, a further field emission may be generated by the conductive nanoparticles 18*a* at the defects which would reduce the life of the carbon nanotubes 16. As a result, the life of the carbon nanotubes 16 may increase.

The conductive nanoparticles 18*a* may be any material which may attach to the external walls of the carbon nanotubes 16 and contribute to the field emission. For example, the conductive nanoparticles 18*a* may be made of metal oxides, metals, or a combination (e.g., an alloy) of at least two thereof. More specifically, the conductive nanoparticles 18*a* may be made of at least one material selected from the group consisting of ZnO, ZnO:Al, $SnO_2$, $In_2O_3$, $Zn_2SnO_4$, $MgIn_2O_4$, $ZnSnO_3$, $GaInO_3$, $Zn_2In_2O_5$, $In_4Sn_3O_{12}$, Pt, Ru, Ir, and Al, but is not limited thereto.

The conductive nanoparticles 18*a* may have an average particle diameter of several nanometers. The average particle diameter of the conductive nanoparticles 18*a* may be equal to or less than an average particle diameter of the carbon nanotubes 16. For example, the conductive nanoparticles 18*a* may have an average particle diameter of about 10 nm or less, for example, about 5 nm or less.

The conductive layer 18*b* may be formed on at least a portion of the surface of the substrate 11. Specifically, the conductive layer 18*b* may be formed on at least a portion of the surface of the substrate 11 on which the carbon nanotubes 16 are not formed and may be formed after the carbon nanotubes 16 are formed on the substrate 11.

The conductive nanoparticles 18*a* attached to the external walls of the carbon nanotubes 16 may be made of the same material as the conductive layer 18*b*. The attachment of the conductive nanoparticles 18*a* and the formation of the conductive layer 18*b* may be simultaneously performed, for example, using an atomic layer deposition method. Thus, the conductive nanoparticles 18*a* may be made of the same material as the conductive layer 18*b*. The atomic layer deposition method will now be described in detail below.

When the field emission electrode 10 is used in a field emission device, the conductive layer 18*b* may function as a cathode. The conductive layer 18*b* may have a specific resistance of about $10^2$ Ωcm or less, for example, between about $1\times10^{-4}$ to about $1\times10^{-2}$ Ωcm.

The conductive layer 18*b* may comprise at least one material selected from the group consisting of metal oxides and metals. The conductive layer 18*b* may also be made of a combination (e.g., an alloy) of at least two thereof. More Specifically, the conductive layer 18*b* may be made of at least one material selected from the group consisting of ZnO, ZnO:Al, $SnO_2$, $In_2O_3$, $Zn_2SnO_4$, $MgIn_2O_4$, $ZnSnO_3$, $GaInO_3$, $Zn_2In_2O_5$, $In_4Sn_3O_{12}$, Pt, Ru, Ir, and Al, but is not limited thereto.

For example, the conductive layer 18*b* may be made of ZnO. ZnO single crystals may be a n-type semiconductor at room temperature, and may have a specific resistance of approximately $10^2$ Ωcm due to oxygen defects, interstitial Zn, hydrogen-related point defects, and/or etc. When the conductive layer 18*b* is made of ZnO, the conductive layer 18*b* may have a specific resistance of about $1\times10^{-5}$-$10^2$ Ωcm.

The conductive layer 18*b* may have a thickness of about 1-1000 nm, for example, about 1-50 nm. When the thickness of the conductive layer 18*b* is adjusted to the afore-mentioned range, the particle size of the conductive nanoparticles 18*a* to be formed together with the conductive layer 18*b* may also be adjusted to a suitable range.

Figure 2:
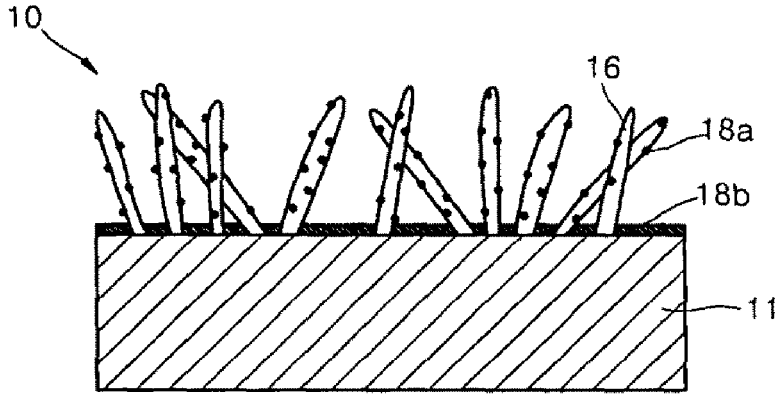

FIG. 2 is a schematic cross-sectional view illustrating a field emission electrode according to an example embodiment.

Referring to FIG. 2, a field emission electrode 10 may comprise a substrate 11, and carbon nanotubes 16 and a conductive layer 18*b* formed on the substrate 11. Conductive nanoparticles 18*a* may be attached to the external walls of the carbon nanotubes 16. In the field emission electrode 10, the conductive layer 18*b* may be formed on the portion of the surface of the substrate on which the carbon nanotubes 16 are not formed. The details of the substrate 11, the carbon nanotubes 16, the conductive nanoparticles 18*a*, and the conductive layer 18*b* are similar to that of the above description, and therefore, will be omitted.

Figure 3:
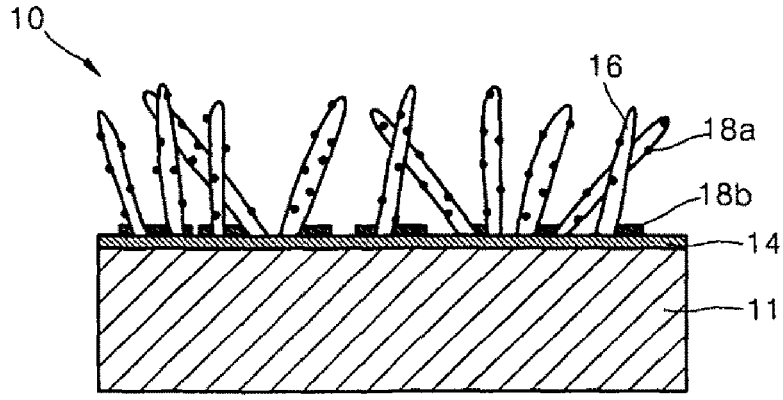

FIG. 3 is a schematic cross-sectional view illustrating a field emission electrode according to an example embodiment.

Referring to FIG. 3, a field emission electrode 10 may comprise a substrate 11, and carbon nanotubes 16 and a conductive layer 18*b* formed on the substrate 11. Conductive nanoparticles 18*a* may be attached to the external walls of the carbon nanotubes 16. In the field emission electrode 10, a thin layer of a catalyst 14 to accelerate the growth of carbon nanotubes may be present on the substrate 11.

The catalyst 14 used to accelerate the growth of the carbon nanotubes 16 may be Fe, Co, Ni, or alloys thereof, but is not limited thereto. The catalyst 14 may be produced in the form of a thin layer on the substrate 11, for example, using a CVD method, a sputtering method, a spin coating method, or an atomic layer deposition method.

The above description provides the details of the substrate 11, the carbon nanotubes 16, the conductive nanoparticles 18*a*, and the conductive layer 18*b*.

Figure 4:
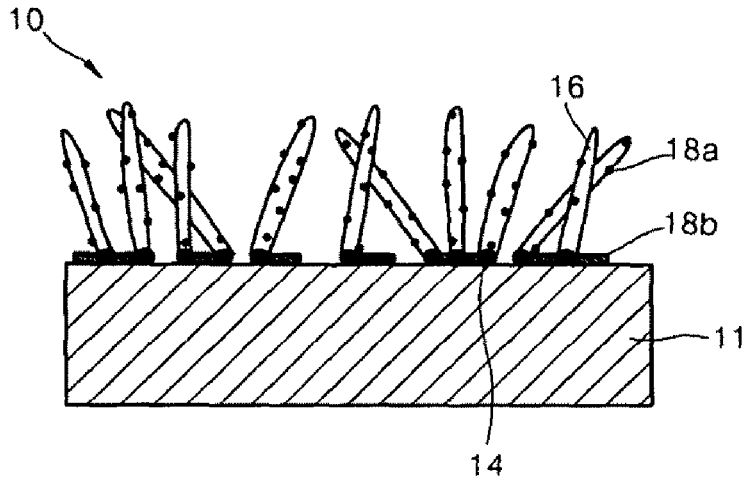

FIG. 4 is a schematic cross-sectional view illustrating a field emission electrode according to example embodiments.

Referring to FIG. 4, catalyst particles 14 to accelerate the growth of carbon nanotubes may be attached to a substrate 11. The above description provides the details of the substrate 11, the carbon nanotubes 16, the conductive nanoparticles 18*a*, the conductive layer 18*b*, and the catalyst 14 used to accelerate the growth of carbon nanotubes.

Figure 5A:
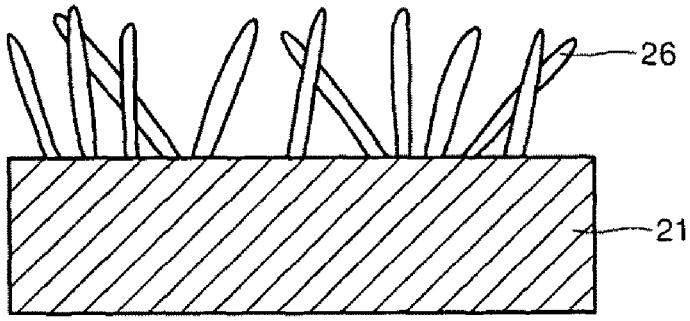
FIGS. 5A and 5B are schematic cross-sectional views illustrating a method of manufacturing a field emission electrode according to an example embodiment.
Figure 5B:
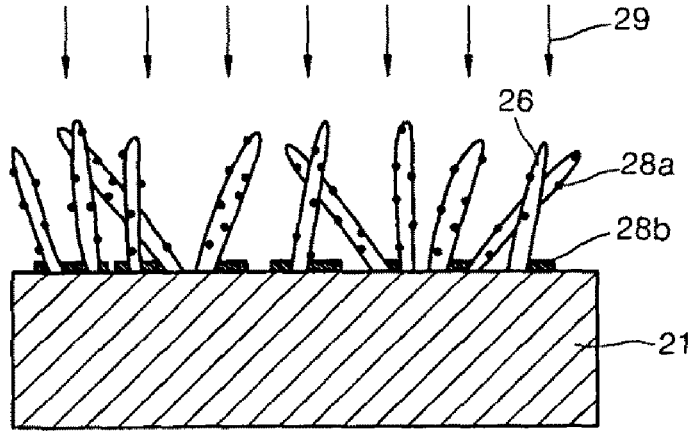

FIGS. 5A and 5B are schematic cross-sectional views illustrating a method of manufacturing a field emission electrode according to example embodiments.

Referring to FIG. 5A, carbon nanotubes 26 may be formed on a substrate 21. The carbon nanotubes 26 may be grown on the substrate 21 using any conventional method known in the art. Alternatively, the carbon nanotubes 26 may be formed on the substrate 21 using a CVD method using $H_2O$ plasma. Before the formation of the carbon nanotubes 26, a thin layer of a catalyst (not shown) used to accelerate the growth of carbon nanotubes as described above may be formed on the substrate 21, or particles of the catalyst may be attached to the substrate 21.

In example embodiments, carbon nanotubes may be formed on a substrate using a CVD method using $H_2O$ plasma. The CVD method may comprise preparing a vacuum chamber, placing a substrate into the vacuum chamber, allowing $H_2O$ to be vaporized, supplying the vaporized $H_2O$ to the vacuum chamber, generating a $H_2O$ plasma discharge in the vacuum chamber, and supplying a source gas to the vacuum chamber to allow carbon nanotubes to grow on the surface of the substrate in the atmosphere of the $H_2O$ plasma.

An apparatus for the CVD method using $H_2O$ plasma as described above may include an apparatus for a remote plasma enhanced chemical vapor deposition (PECVD), but is not limited thereto. In a plasma CVD apparatus, a power supply for generating a discharge may be classified as a direct current (DC) power supply and a high frequency power supply. As representatives of the high frequency power supply, radio frequency (RF) (13.56 MHz) and microwave frequency (2.47 GHz) may be used. In the plasma CVD method, a glow discharge may be generated in a vacuum chamber by the high frequency power supply applied between two electrodes. The apparatus of the plasma CVD method is well known and thus, a detailed explanation thereof is omitted.

In the plasma CVD method, a vacuum chamber may be prepared. In a general plasma CVD apparatus, a vacuum chamber may have a RF plasma coil for generating plasma and a heating furnace for heating the vacuum chamber to a predetermined or given temperature.

A substrate on which carbon nanotubes will grow may then be placed into the vacuum chamber. The substrate may be made of Si, $SiO_2$, or glass. A catalyst to accelerate the growth of carbon nanotubes may be present in the form of a thin layer on the substrate. The catalyst may include Fe, Ni, and/or Co and may be formed on the substrate using a heat deposition method, a sputtering method, a spin coating method, or etc.

Subsequently, $H_2O$ may be allowed to be vaporized, and the vaporized $H_2O$ may be supplied to the vacuum chamber. At this time, the vacuum chamber may be slowly heated and maintained at about 500° C. or less.

A RF power supply may be applied to the RF plasma coils in the vacuum chamber, thereby generating a $H_2O$ plasma discharge in the vacuum chamber. The power of the $H_2O$ plasma may be adjusted to about 80 W or less.

A source gas for growing carbon nanotubes may then be supplied to the vacuum chamber to allow carbon nanotubes to grow on the surface of the substrate in the atmosphere of the $H_2O$ plasma. The source gas to synthesize the carbon nanotubes may include $C_2H_2$, $CH_4$, $C_2H_4$, $C_2H_6$, and CO, but is not limited thereto. The flow rate of the source gas will depend on the growth conditions of the carbon nanotubes, but may be about 20-60 sccm. The growth of the carbon nanotubes will depend on the growth conditions of the carbon nanotubes and may be performed for about 10-600 seconds.

When the CVD method using $H_2O$ plasma as described above is used, carbon nanotubes (e.g., SWNTs) may be formed at a lower temperature, for example, about 500° C. or less.

The $H_2O$ plasma may function as a mild oxidant or a mild echant during the growth of the carbon nanotubes, thereby removing carbonaceous impurities from the carbon nanotubes. In the atmosphere of the $H_2O$ plasma, the carbon nanotubes may be grown at a relatively lower temperature (e.g., about 500° C. or less), and thus, amounts of impurities (e.g., amorphous carbon) generated when the carbon nanotubes are grown at a higher temperature of at least about 800° C. may be reduced. Thus, SWNTs having reduced amounts of carbonaceous impurities and disordered carbon may be obtained using the above method. The SWNTs may have better crystallinity when they are grown at lower temperatures as described above.

Referring to FIG. 5B, after forming the carbon nanotubes 26 on the substrate 21, a conductive layer 28*b* may be formed on at least a portion of the surface of the substrate 21 simultaneously with attaching conductive nanoparticles 28*a* to the external walls of the carbon nanotubes 26.

An atomic layer deposition method 29 may be used. The atomic layer deposition method is a technique of forming a nano thin layer based on the surface saturation reaction. Using the atomic layer deposition method, the conductive nanoparticles 28*a* may be selectively attached to defects which may be present on the external walls of the carbon nanotubes 26.

Carbon nanotubes may have a structure of a hexagonal honeycomb due to the $sp^2$ bonds between the carbon atoms comprising the carbon nanotubes. Thus, any chemical species may be adsorbed on ideal carbon nanotubes which may have no defects or impurities. However, it is more practical for carbon nanotubes to have defects, which may reduce the life of the carbon nanotubes.

The defects of the external walls of the carbon nanotubes may be sites to which precursors of the conductive nanoparticles may be attached during the atomic layer deposition method. Thus, the conductive nanoparticles may attach to the defects of the carbon nanotubes, thereby increasing the life of the carbon nanotubes and enhancing the field emission property. Further, various species (e.g., —OH, and etc.) which may be inherently present on the substrate 21, a catalyst which may be necessary to grow the carbon nanotubes 26, and byproducts which may be generated during the growth of the carbon nanotubes 26 may be present on the substrate 21 and may react with precursors of the conductive layer 28*b* during the atomic layer deposition method. The precursors of the conductive nanoparticles 28*a* may be the same as the precursors of the conductive layer 28*b*. That is, when the precursors are deposited on the substrate 21 having the carbon nanotubes 26 formed thereon (as illustrated in FIG. 5A) using the atomic layer deposition method, precursors attached to the external walls of the carbon nanotubes 26 may become the conductive nanoparticles 28*a* and precursors attached to the surface of the substrate 21 may become the conductive layer 28*b*.

For example, when the conductive nanoparticles 28*a* and the conductive layer 28*b* are formed with ZnO using the atomic layer deposition method, for example, diethylzinc and water may be used as the precursors. In this case, ZnO nanoparticles may be attached to the external walls of the carbon nanotubes 26 and simultaneously, a layer of ZnO may be formed on the substrate 21.

The deposition temperature may be adjusted to about 100-500° C., for example, 150°-300° C., and the pressure in the chamber may be adjusted to about 5 torr or less, for example, about 0.1-2 torr.

As described above, the field emission electrode according to example embodiments may be used in a field emission device. The field emission device may comprise a substrate, the field emission electrode, a gate electrode insulated from the field emission electrode, a second electrode disposed opposite to the field emission electrode, and a fluorescent layer disposed on the bottom side of the second electrode. The field emission device may be used for various applications (e.g., field emission displays (FEDs), backlight units, X-ray source, e-beam guns, and etc.).

Figure 6:
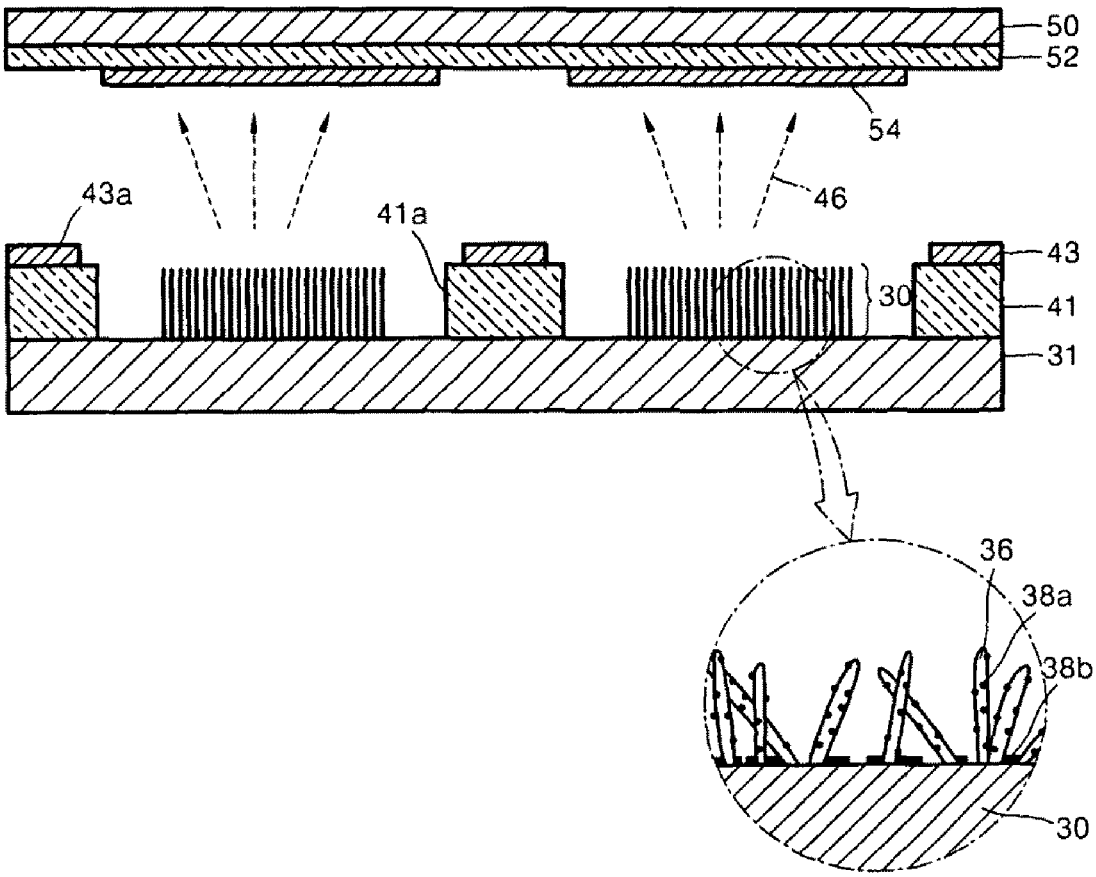

FIG. 6 is a schematic cross-sectional view illustrating a field emission device comprising a field emission electrode according to example embodiments.

Referring to FIG. 6, the field emission device may comprise a first substrate 31 and a second substrate 50. The first substrate 31 may be separated from the second substrate 50 by a predetermined or given distance. An insulating layer 41 may be formed on the first substrate 31 and a gate electrode 43 may be formed on the insulating layer 41. The insulating layer 41 may have gate holes 41*a* exposing a field emission electrode 30, and the gate electrode 43 may have gate electrode holes 43*a* that are in communication with the gate holes 41*a*. The description of the field emission electrode 30 is similar to that described above, and thus, is omitted.

A second electrode 52 and a fluorescent layer 54 may be sequentially formed on the inner side of the second substrate 50.

When a negative voltage is applied to the gate electrode 43 and the field emission electrode 30, electrons 46 may be emitted from emitters (e.g., carbon nanotubes 36). A conductive layer 38*b* may function as a cathode, and conductive nanoparticles 38*a* attached to the external walls of the carbon nanotubes 36 may reduce or prevent a reduction of the life of the carbon nanotubes 36. The electrons 46 may be directed towards the anode 52 to which a positive voltage is applied and may excite the fluorescent layer 54, thereby emitting light.

Even though the field emission device according to example embodiments has been described in reference to FIG. 6, it is not limited thereto, and various changes to the field emission device may be made.

Hereinafter, example embodiments will be described in more detail with reference to the following examples. However, these examples are for illustrative purposes only and are not intended to limit the scope of example embodiments.

Example a) Synthesis of Single-Wall Carbon Nanotubes (SWNTs)

To allow observation by transmission electron microscopy, a copper grid was provided and a solution containing catalyst particles (an aqueous solution containing iron nitrate, bis (acetylacetonate)dioxomolybdenum, and alumina nanoparticles) for growing carbon nanotubes were spin coated on the copper grid to form a catalytic layer for growing carbon nanotubes. Then, the coated grid was placed into a vacuum chamber of a plasma CVD apparatus (a remote plasma enhanced CVD apparatus), and a $H_2O$ plasma discharge was generated to grow carbon nanotubes. Growth conditions of the carbon nanotubes are described in Table 1.

TABLE 1

| | |
|---|---|
| Temperature in vacuum chamber | 450° C. |
| Pressure in vacuum chamber | 0.37 torr |
| $H_2O$ Plasma power | 15 W |
| Source gas | $CH_4$ (introduced together with water) |
| Flow rate of source gas | 60 sccm |
| Synthesis time of carbon nanotubes | 180 sec |

Figure 7A:
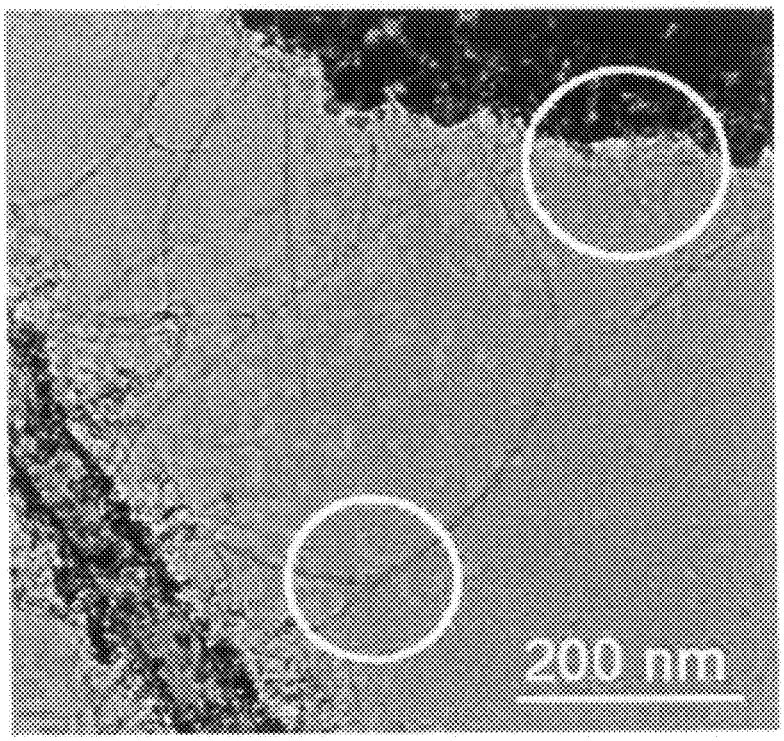
FIGS. 7A through 7C illustrate transmission electron microscope (TEM) images of carbon nanotubes on a field emission electrode according to an example embodiment.
Figure 7B:
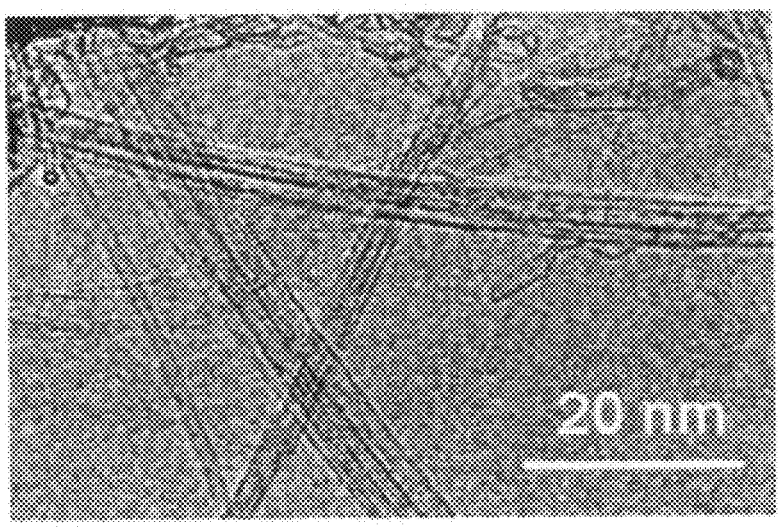
Figure 7C:
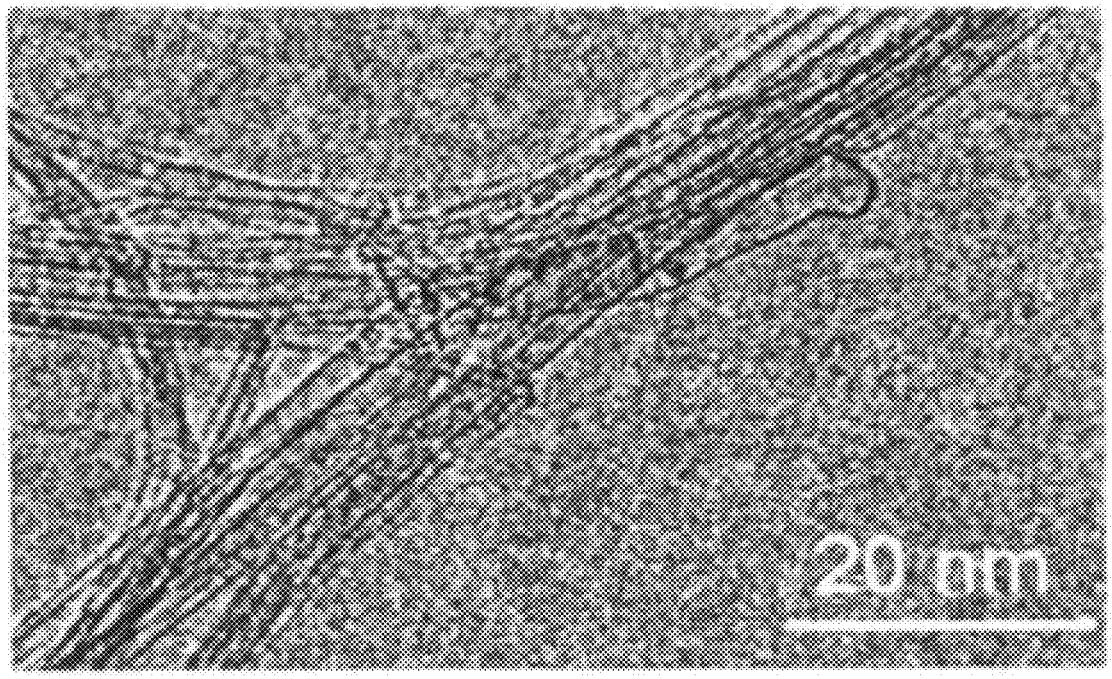

FIGS. 7A through 7C illustrate transmission electron microscope (TEM) images, taken at different magnifications, of carbon nanotubes on a field emission electrode according to example embodiments. The carbon nanotubes were grown at the above-mentioned conditions. It may be confirmed from FIGS. 7A through 7C that SWNTs were synthesized.

b) Formation of a ZnO Layer and ZnO Nanoparticles Using an Atomic Layer Deposition (ALD) Method The copper grid on which SWNTs were grown, as described above, was placed into a chamber of an ALD apparatus, and then, an ALD method was performed using water and diethyizinc as a precursor. Conditions are described in Table 2.

TABLE 2

| | |
|---|---|
| Temperature in chamber | 200° C. or 250° C. |
| Pressure in chamber | 0.7 torr |
| ALD cycle | 37, 70, or 200 |
| Precursor | Diethylzinc and Water |
| Zn-purge-$H_2O$-purge | 2-5-2-5 sec |

Figure 8A:
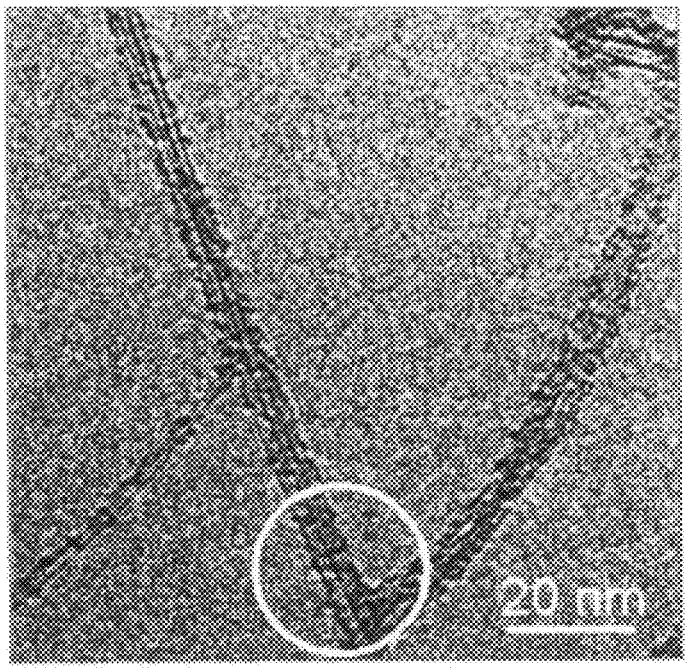
FIGS. 8A and 8B illustrate TEM images of carbon nanotubes having ZnO nanoparticles attached thereto as obtained in an example.
Figure 8B:
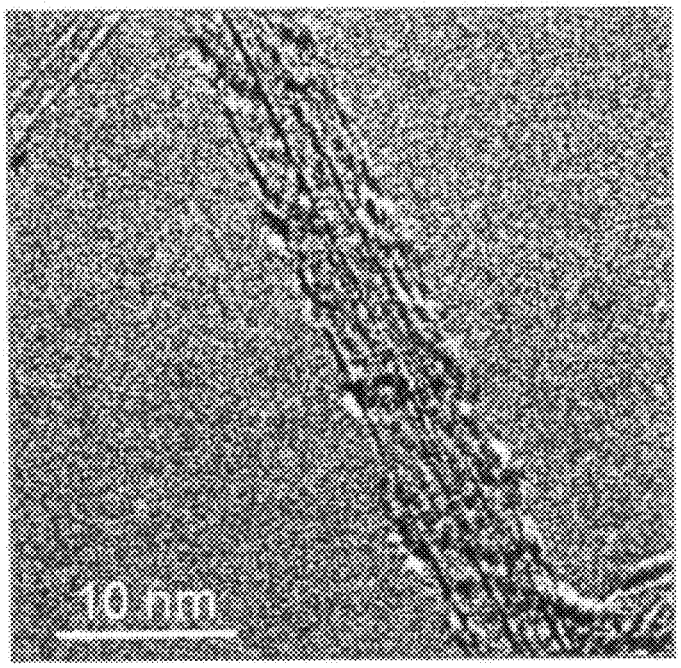

FIGS. 8A and 8B illustrate TEM images, taken at different magnifications of carbon nanotubes having ZnO nanoparticles attached thereto as obtained in the above example. It may be confirmed from FIGS. 8A and 8B that ZnO nanoparticles were attached to the external walls of the SWNTs.

Figure 9A:
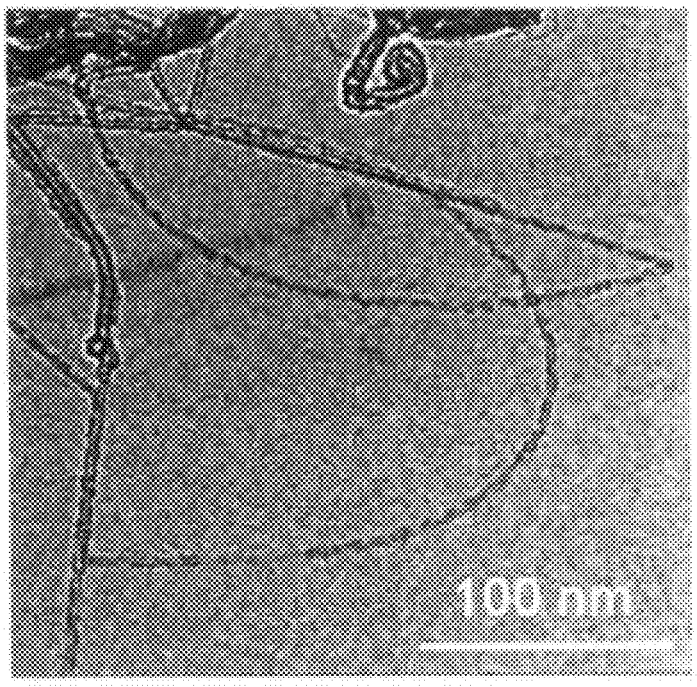
FIGS. 9A and 9B illustrate a TEM image of carbon nanotubes having ZnO nanoparticles attached thereto as obtained in an example and its Z-contrast image.
Figure 9B:
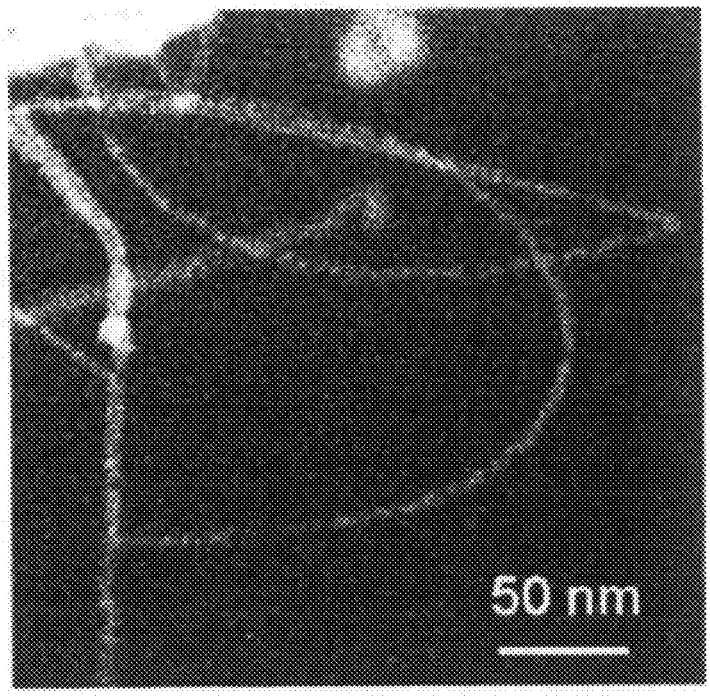

FIGS. 9A and 9B illustrate a TEM image of carbon nanotubes having ZnO nanoparticles attached thereto as obtained in the above example and its Z-contrast image, respectively. It may be more clear from FIGS. 9A and 9B that ZnO nanoparticles were attached to the external walls of the SWNTs. Referring to FIG. 9B, light portions indicate ZnO and dark portions indicate the SWNTs.

Comparative Example a) Synthesis of Single-Wall Carbon Nanotubes (SWNTs)

SWNTs were synthesized according to the description in "a) Synthesis of single-wall carbon nanotubes (SWNTs)" of the above example.

Evaluation Example

Figure 10:
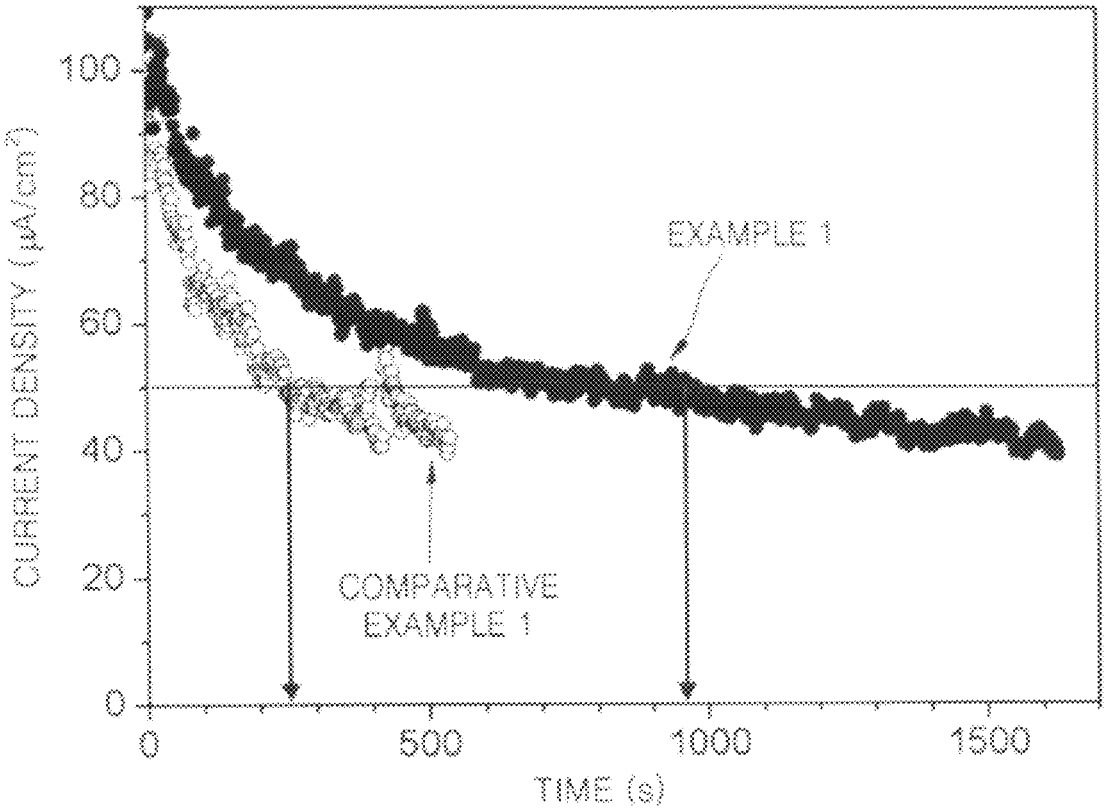

For the SWNTs obtained in the above example and the SWNTs obtained in the comparative example, current density vs. time was measured to evaluate the life of the carbon nanotubes, respectively. FIG. 10 is a graph illustrating current density vs. time of the carbon nanotubes obtained in the above examples and the comparative example, respectively. The current density was measured at $10^{-7}$ mbar using a picoammeter and a DC power supply device. Referring to FIG. 10, in the case of the SWNTs obtained in the above example, it took about 1000 seconds for the current density to be reduced to half its initial value, whereas in the case of the SWNTs obtained in the comparative example, it took about 250 seconds. As a result, it is confirmed that the carbon nanotubes according to example embodiments may have a longer life.

As described above, the field emission electrode according to example embodiments may have a longer life, and thus, the field emission device using the field emission electrode may be of a higher quality.

The foregoing is illustrative of example embodiments and is not to be construed as limiting thereof. Although example embodiments have been described, those skilled in the art will readily appreciate that many modifications are possible in example embodiments without materially departing from the novel teachings and advantages of example embodiments. Accordingly, all such modifications are intended to be included within the scope of the claims. Therefore, it is to be understood that the foregoing is illustrative of example embodiments and is not to be construed as limited to the specific embodiments disclosed, and that modifications to the disclosed embodiments, as well as other embodiments, are intended to be included within the scope of the appended claims. Example embodiments are defined by the following claims, with equivalents of the claims to be included therein.

What is claimed is:

1. A method of manufacturing a field emission electrode, comprising:

forming carbon nanotubes on a substrate; and forming a conductive layer on at least a portion of a surface of the substrate simultaneously with attaching conductive nanoparticles to external walls of the carbon nanotubes.

2. The method of claim 1, wherein the forming of carbon nanotubes is performed using a chemical vapor deposition method using $H_2O$ plasma.

3. The method of claim 2, wherein the chemical vapor deposition method using $H_2O$ plasma comprises:

preparing a vacuum chamber;

placing a substrate into the vacuum chamber;

allowing $H_2O$ to be vaporized and supplying the vaporized $H_2O$ to the vacuum chamber;

generating a $H_2O$ plasma discharge in the vacuum chamber; and supplying a source gas to the vacuum chamber to allow carbon nanotubes to grow on a surface of the substrate in an atmosphere of the $H_2O$ plasma.

4. The method of claim 2, wherein the carbon nanotubes are formed at a temperature of about 500° C. or less.

5. The method of claim 1, wherein the formation of the conductive layer and the attachment of the conductive nanoparticles are performed using an atomic layer deposition method.

6. The method of claim 2, further comprising:

forming a catalyst layer on the substrate.

7. The method of claim 6, wherein the forming a catalyst layer includes forming one of a thin layer of a catalyst and attaching particles of the catalyst to the substrate, and the catalyst accelerates the formation of the carbon nanotubes.

8. The method of claim 5, wherein the attachment of the conductive nanoparticles includes setting process parameters such that the conductive nanoparticles selectively attach to defects of the external walls of the carbon nanotubes.

* * * * *